United States Patent [19]

Newton

[11] Patent Number: 4,525,185

[45] Date of Patent: Jun. 25, 1985

[54] DUAL MIXED REFRIGERANT NATURAL GAS LIQUEFACTION WITH STAGED COMPRESSION

[75] Inventor: Charles L. Newton, Bethlehem, Pa.

[73] Assignee: Air Products and Chemicals, Inc., Allentown, Pa.

[21] Appl. No.: 545,408

[22] Filed: Oct. 25, 1983

[51] Int. Cl.[3] ..... F25J 3/00

[52] U.S. Cl. ..... 62/11; 62/40

[58] Field of Search ..... 62/9, 11, 40, 335, 510, 62/114

[56] References Cited

U.S. PATENT DOCUMENTS

| | | | |
|---|---|---|---|
| 3,964,891 | 6/1976 | Krieger | 62/40 |
| 4,112,700 | 9/1978 | Forg | 62/28 |
| 4,274,849 | 6/1981 | Garier et al. | 62/9 |
| 4,339,253 | 7/1982 | Caetani et al. | 62/40 |

OTHER PUBLICATIONS

Paradowski, H., and Squera, O., "La Liquefaction des Gas Associes" 7th International Conference on LNG, May 15–19, 1983, (Abstract in English).

*Primary Examiner*—Frank Sever

*Attorney, Agent, or Firm*—Geoffrey L. Chase; James C. Simmons; E. Eugene Innis

[57] ABSTRACT

An apparatus and process for liquefying natural gas using two closed-cycle, multicomponent refrigerants; a low level refrigerant which cools the natural gas and a high level refrigerant which cools the low level refrigerant wherein the improvement comprises phase separating the high level refrigerant after compression and fully liquefying the vapor phase stream against external cooling fluid after additional compression.

6 Claims, 2 Drawing Figures

DUAL MIXED REFRIGERANT NATURAL GAS LIQUEFACTION WITH STAGED COMPRESSION

TECHNICAL FIELD

The present invention is directed to a process for the liquefaction of natural gas or other methane-rich gas streams. The invention is more specifically directed to a dual mixed component refrigerant liquefaction process utilizing a more efficient flowpath for the refrigerants utilized to liquefy the natural gas or methane-rich gas stream.

BACKGROUND OF THE PRIOR ART

The recovery and utilization of natural gas and other methane-rich gas streams as economic fuel sources have required the liquefaction of the gas in order to provide economic transportation of the gas from the site of production to the site of use. Liquefaction of large volumes of gas is obviously energy intensive. In order for natural gas to be available at competitive prices the liquefaction process must be as energy efficient as possible.

Inefficiencies in liquefaction processes are usually present when the compression load on the refrigeration equipment used to perform the liquefaction is not balanced on the drivers or electric motors used to run the equipment in a single component refrigerant cycle, specifically when such equipment is matched throughout the liquefaction installation. Compression load is the major power comsuming function of a liquefaction process. In addition, a liquefaction process must be readily adaptable to varying regions with their specific climatic conditions. Such climatic conditions may also vary seasonally particularly in the more polar extreme regions of the world. Such climatic conditions affect a liquefaction process predominantly in the temperature of the cooling water utilized in the production of refrigeration used to liquefy the natural gas. The sizeable variations in the temperature of available cooling water due to changing seasons or different climatic zones can cause imbalances in the various refrigeration cycles.

Other inefficiencies may also arise aside from the matching of compression load with compression drivers in the refrigeration cycles. Such inefficiencies usually reside in the matching of gas to be liquefied against refrigerant to perform the liquefaction. For a multicomponent stage flash cycle, compositional variations and constraints have plagued those skilled in the art.

Various attempts have been made to provide efficient liquefaction processes, which are readily adaptable to varying ambient conditions and multiple component, multiple cycle refrigerant processes. In U.S. Pat. No. 4,112,700 a liquefaction scheme for processing natural gas is set forth wherein two closed cycle refrigerant streams are utilized to liquefy natural gas. A first high level (higher temperature) precool refrigerant cycle is utilized in multiple stages to cool the natural gas. The refrigerant is not initially condensed totally against cooling water. This first high level precool refrigerant is phase separated in multiple stages, wherein the effect is to return the light component portions of the refrigerant for recycle, while the heavy component portions of the refrigerant are retained to perform the cooling at lower temperatures of the natural gas. The first high level precool refrigerant is also utilized to cool the second low level (lower temperature) refrigerant. The second low level refrigerant performs the liquefaction of the natural gas in a single stage. The drawback in this process is that the high level precool refrigerant after initial phase separation utilizes heavier and heavier molecular weight components to do lower and lower temperature cooling duty. This is contrary to the desired manner of efficient cooling of the present invention. Further, the second or low level refrigerant is used in a single stage to liquefy the natural gas, rather than performing such liquefaction in multiple stages. Finally, the high level refrigerant is not totally condensed against external cooling fluid prior to its refrigeration duty.

U.S. Pat. No. 4,274,849 discloses a process for liquefying a gas rich in methane, wherein the process utilizes two separate refrigeration cycles. Each cycle utilizes a multicomponent refrigerant. The low level (lower temperature) refrigerant cools and liquefies the natural gas in two stages by indirect heat exchange. The high level (higher temperature) refrigerant does not heat exchange with the natural gas to be liquefied, but cools the low level refrigerant by indirect heat exchange in an auxiliary heat exchanger. This heat exchange is performed in a single stage.

U.S. Pat. No. 4,339,253 discloses a dual refrigerant liquefaction process for natural gas, wherein a low level refrigerant cools and liquefies natural gas in two stages. This low level refrigerant is, in turn, cooled by a high level refrigerant in a single stage. The high level refrigerant is used to initially cool the natural gas only to a temperature to remove moisture therefrom before feeding the dry natural gas to the main liquefaction area of the process. The use of such individual stage heat exchange between the cycles of a dual cycle refrigerant liquefaction process precludes the opportunity to provide closely matched heat exchange between the cycles by the systematic variation of the refrigerant compositions when the refrigerants constitute mixed component refrigerant.

In the literature article Paradowski, H. and Squera, O., "Liquefaction of the Associated Gases", Seventh International Conference on LNG, May 15–19, 1983, a liquefaction scheme is shown in FIG. 3 wherein two closed refrigeration cycles are used to liquefy a gas. The high level cycle depicted at the right of the flowscheme is used to cool the low level cycle as well as cool for moisture condensation an initial gas stream. The high level refrigerant is recompressed in multiple stages and cools the low level refrigerant in three distinct temperature and pressure stages. Alteration of the high level refrigerant composition to match the various stages of refrigeration in the heat exchanger is not contemplated.

The present invention overcomes the drawbacks of the prior art by utilizing a unique flowscheme in a liquefaction process utilizing two multiple component refrigerants in closed cycles, where the refrigerants are heat exchanged one with another in multiple stages while the refrigerant composition of the high level refrigerant is varied such that lighter molecular weight components of the refrigerant are available to perform the lower level (low temperature) refrigeration duty which is best suited to such lower molecular weight components.

BRIEF SUMMARY OF THE INVENTION

The present invention is directed to an improved process for the liquefaction of natural gas or other methane-containing gas streams using two closed cycle, multicomponent refrigerants wherein high level refrigerant cools a low level refrigerant and the low level refrigerant cools and liquefies the natural gas or methane-rich gas stream in which the gas is cooled and liquefied by heat exchange with a low level multicomponent refrigerant in a first closed refrigeration cycle which refrigerant is rewarmed during said heat exchanger, the low level refrigerant is compressed to an elevated pressure and aftercooled against an external cooling fluid, the low level refrigerant is further cooled by multiple stage heat exchange against a high level multicomponent refrigerant in a second closed refrigeration cycle, which high level refrigerant is rewarmed during said heat exchange, the high level refrigerant is compressed to an elevated pressure and aftercooled against an external cooling fluid to partially liquefy said refrigerant, the high level refrigerant is phase separated into a vapor phase refrigerant stream and a liquid phase refrigerant stream and then portions of the liquid phase refrigerant stream are subcooled and expanded to lower temperature and pressure in multiple stages to provide the cooling of the low level refrigerant and to cool and to liquefy the vapor phase refrigerant stream, the improvement comprising compressing the vapor phase refrigerant stream and condensing it against an external cooling fluid for subcooling it against the liquid phase stream and expanding the condensed vapor phase to lower temperature and pressure to provide the lowest stage of cooling to the low level refrigerant.

Preferably, the process includes only partial condensation of the compressed vapor phase of the high level refrigerant such that a second phase separation is performed to further isolate lighter components in the resulting second vapor phase stream and the heavier components in the second liquid phase stream can be returned to the initial liquid phase high level refrigerant stream. The second vapor phase stream is further compressed and aftercooled against an external cooling fluid to fully liquefy the stream such that all streams going to the multistage heat exchanger have been fully liquefied against the external cooling fluid.

The present invention is also directed to an improved apparatus for the liquefaction of natural gas or a methane-rich gas stream using two closed cycle, multicomponent refrigerants wherein the high level refrigerant cools the low level refrigerant and the low level refrigerant cools and liquefies the natural gas, such as apparatus having a first heat exchanger for cooling and liquefying natural gas against a low level refrigerant, at least one compressor for compressing low level refrigerant to an elevated pressure, an auxiliary heat exchanger for cooling the low level refrigerant against high level refrigerant in multiple stages, a phase separator for separating the low level refrigerant into a vapor phase stream and a liquid phase stream, means for conveying the vapor phase stream and the liquid phase stream separately to said first heat exchanger and recycling same to said compressor, at least one compressor for compressing high level refrigerant to an elevated pressure, an aftercooling heat exchanger for cooling the compressed high level refrigerant against an external cooling fluid, a phase separator for separating the high level refrigerant into a vapor phase stream and a liquid phase stream, means for conveying said high level vapor phase stream through said auxiliary heat exchanger and expanding said stream in order to cool the low level refrigerant stream, means for conveying said high level liquid phase stream through said auxiliary heat exchanger including means for separating portions of said stream therefrom and then individually expanding them to a lower temperature and pressure to cool said low level refrigerant and means for recycling the high level refrigerant for recompression, the improvement comprising a compressor and aftercooling heat exchanger for liquefying said vapor phase stream of said high level refrigerant.

Preferably the apparatus includes a second phase separator for separating a second liquid phase high level refrigerant stream, means for combining the second liquid phase stream with the first liquid phase high level refrigerant stream, a compressor and an aftercooling heat exchanger for liquefying the vapor phase from the second phase separator.

DETAILED DESCRIPTION OF THE INVENTION

Figure 1:
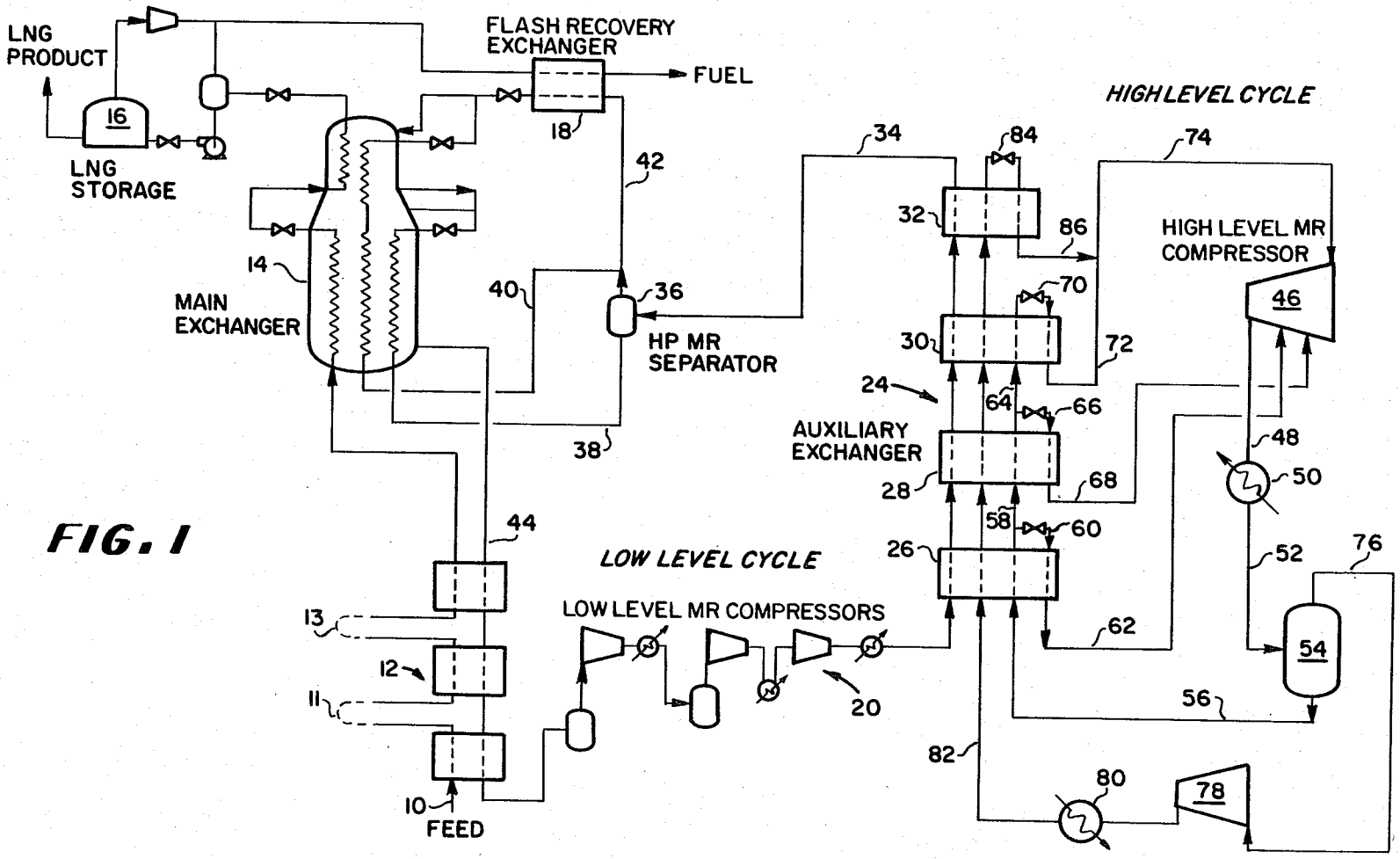
FIG. 1 is a flowscheme of the overall process of the present invention showing the preferred mode of operation of the high level refrigerant cycle.

The present invention will be described in greater detail with reference to the accompanying drawings wherein several preferred embodiments of operation of the present invention are set forth. With reference to FIG. 1, a natural gas feed stream is introduced into the process of the present invention in line 10. The natural gas would typically have a composition as follows:

| | |
|---|---|
| $C_1$ | 91.69% |
| $C_2$ | 4.56% |
| $C_3$ | 2.05% |
| $C_4$ | 0.98% |
| $C_{5+}$ | 0.43% |
| $N_2$ | 0.31% |

This feed is introduced at approximately 93° F. and over 655 psia. Prior to liquefaction, a significant portion of the hydrocarbons heavier than methane must be removed from the feedstream. In addition, any residual moisture content must also be removed from the feedstream. These preliminary treatment steps do not form a portion of the present invention and are deemed to be standard pretreatment processes, which are well known in the prior art. Therefore, they will not be dealt with in the present description. Suffice it to say that the feedstream in line 10 is subjected to initial cooling by heat exchange in heat exchanger 12 against a low level (low temperature) refrigerant in line 44. The precooled natural gas is circuited through drying and distillation apparatus to remove moisture and higher hydrocarbons. This standard clean-up step is not shown in the drawing other than to indicate that it is generally done prior to liquefaction at stations 11 and 13.

The natural gas, now free of moisture and significantly reduced in higher hydrocarbons, is fed to the main heat exchanger 14 which preferably consists of a two bundle coil wound heat exchanger. The natural gas is cooled and totally condensed in the first stage or bundle of the main heat exchanger 14. The liquefied natural gas is then subcooled to a temperature of approximately −240° F. in the second stage or bundle of the exchanger 14. The liquefied natural gas then leaves the exchanger, is flashed through a valve and is phase separated to provide flash gas and product liquefied natural gas which is pumped to a storage containment 16. LNG product can then be removed as desired. Vapor forming over the stored LNG is compressed to pressure and combines with the flash gas to be rewarmed in flash gas recovery exchanger 18 before being used as fuel, preferably the fuel necessary to operate the plant of the present invention.

As recited in the summary of the invention, the process of the present invention involves the liquefaction of natural gas using two closed cycle refrigerants. A low level refrigerant cycle provides the lowest temperature level of refrigerant for the liquefaction of the natural gas. The low level (lowest temperature) refrigerant is in turn cooled by high level (relatively warmer) refrigerant in a separate heat exchanger between the low level refrigerant and the high level refrigerant.

The low level multicomponent refrigerant used in the present invention, which actually performs the cooling, liquefaction and subcooling of the natural gas, is typically comprised of methane, ethane, propane an butane. The exact concentration of these various components in the low level refrigerant is dependent upon the ambient conditions and particularly, the temperature of external cooling fluids, which are used in the liquefaction plant. The exact composition and concentration range of the components of the low level refrigerant is also dependent upon the exact power shift or balance desired between the low level refrigerant cycle and the high level refrigerant cycle.

The low level refrigerant is compressed in multiple stages and aftercooled against external cooling fluid in compressor assembly 20. Ambient cooling fluid, such as sea water, is usually utilized to remove the heat of compression.

The low level refrigerant at approximately 103° F. and 634 psia is further cooled against high level refrigerant in a multistage auxiliary heat exchanger 24. In the preferred embodiment, the auxiliary heat exchanger 24 has four stages, warm stage 26, intermediate stage 28, intermediate stage 30 and cold stage 32. The low level refrigerant exits the auxiliary heat exchanger 24 partially liquefied in line 34. The low level refrigerant is then phase separated in separator vessel 36 at a cut temperature of approximately −50° F. The liquid phase of the low level refrigerant is removed in line 38 and introduced into the first bundle of the main heat exchanger 14 for further cooling before being removed from the exchanger, reduced in temperature and pressure through a valve and reintroduced at approximately −200° F. into the shell side of the exchanger as a spray which descends over the various tubes in the first bundle of the main heat exchabger. The vapor phase stream from separator 36 is split into a slipstream 42 and the main vapor stream 40. The main vapor stream 40 is also introduced into the main heat exchanger 14 in the first bundle and continues through the second bundle where it is fully liquefied and subcooled before it is removed for reduction in temperature and pressure through a valve. The slipstream of the vapor phase in line 42 passes through flash recovery heat exchanger 18 to recover refrigeration duty from the flash natural gas. This stream is also reduced in temperature and pressure and is combined with the stream in line 40 and is introduced into the overhead of the main heat exchanger 14 at approximately −240° F. as a spray which descends over the tube bundles of both the first stage and second stage of the main heat exchanger. The rewarmed refrigerant is removed in line 44 at the base of the main heat exchanger 14 for recycle within the closed cycle of the low level refrigerant. It will be noted that the entire heat exchange duty for the liquefaction of the natural gas is done against the low level refrigerant and the high level refrigerant is not utilized to perform refrigeration duty on the natural gas stream.

A high level refrigerant, which is utilized at a refrigeration duty temperature significantly above the low level refrigerant, constitutes the second of the two closed cycle refrigerant systems of the present invention. The high level refrigerant is utilized only to cool the low level refrigerant in indirect heat exchange. The high level refrigerant does not perform a cooling function on the natural gas which is being liquefied. The high level refrigerant typically contains ethane and propane as a multicomponent refrigerant, but may also contain various butanes and pentanes to provide a mixed component refrigerant with the particular refrigeration duty requirements for a particular installation. This high level refrigerant is introduced at various pressure levels into a multistage compressor 46. The high level refrigerant in the vapor phase is removed in line 48 at a temperature of approximately 170° F. and a pressure of approximately 350 psia. The refrigerant is aftercooled in heat exchanger 50 against an external cooling fluid, such as ambient temperature water. The high level refrigerant is partially condensed by the external cooling fluid and exits the heat exchanger 50 in line 52 as a vapor and liquid phase mixture. The refrigerant is phase separated in separator 54.

The vapor phase stream in line 76 is removed from the top of the separator 54 and is further compressed in compressor 78 to a pressure of approximately 446 psia. The vapor phase refrigerant is at such a pressure that it can be fully condensed against the ambient external cooling fluid in aftercooling heat exchanger 80. Again, the external cooling fluid is preferably ambient water. The fully condensed refrigerant stream in line 82 is then subcooled by passage through the various stages 26, 28, 30 and 32 of the auxiliary heat exchanger 24. By performing the phase separation in separator 54, the lighter components of the mixed component high level refrigerant are isolated in the vapor phase stream 76 which eventually performs the lowest temperature level of cooling required in stage 32 of the auxiliary heat exchanger 24. This provides an efficient cooling and better utilization of the multicomponent refrigerant. In addition, this capability provides a unique advantage over nonmulticomponent refrigerant processes.

The liquid phase refrigerant stream from separator 54 is removed from the bottom of said separator in line 56. The refrigerant passes through the high level (warm) stage 26 of the auxiliary heat exchanger 24 before being split into a remaining stream 58 and a sidestream 60 which is flashed to reduced temperature and pressure through a valve. The sidestream in line 60 passes countercurrently back through the high level stage 26 to provide the cooling of the refrigerant streams passing in the opposite direction through the same stage. The rewarmed and vaporized refrigerant is returned for recompression in line 62 to the compressor 46.

The remaining liquid phase refrigerant in line 58 passes through intermediate level heat exchanger stage 28 and a second sidestream 66 is removed from the remaining stream 64. The sidestream 66 is flashed to lower temperature and pressure through a valve and passes countercurrently through the intermediate level stage 28 to provide cooling of the refrigerant streams passing in the opposite direction. The rewarmed and vaporized refrigerant is returned in line 68 for recompression in compressor 46.

The remaining liquid phase stream in line 64 further passes through intermediate level stage 30 and is entirely flashed through valve 70 to a lower temperature and pressure before being countercurrently passed through stage 30 to provide the cooling of the refrigerant streams passing in the opposite direction through stage 30. The rewarmed and vaporized refrigerant is returned in line 72 and line 74 for recompression in compressor 46.

The refrigerant stream in line 82 which passes through all of the auxiliary exchanger stages, including stage 32, is flashed through valve 84 to a lower temperature and pressure and also returns countercurrently through that stage to provide the lowest level of cooling in the auxiliary heat exchanger and is returned for recompression in line 86. It is recombined with the refrigerant stream in line 74.

The unique manner of operating the high level refrigerant cycle of this dual mixed component refrigerant liquefaction scheme allows the refrigerant to be tailored to the particular refrigeration duty in the various stages of the auxiliary heat exchanger. Particularly, the low level cooling duty required in stage 32 is performed by a refrigerant stream which is specifically composed of light molecular weight refrigerant components due to the phase separation occuring in separator 54. However, the full cooling capacity of the ambient cooling fluid is utilized by the further compression in compressor 78 which allows the ambient cooling fluid to fully condense the vapor stream in aftercooling heat exchanger 80. It has been found, that increased efficiencies in refrigeration can be achieved by fully condensing the refrigerant performing the cooling duty in the cycle against the ambient external cooling fluid, such as ambient water.

In addition, the high level refrigeration cycle of the present invention also separates the refrigerant streams of the liquid phase stream in line 56 as said stream passes through the high and intermediate stages of the auxiliary heat exchanger 24 in such a way as to avoid the isolation of heavy components in the various colder temperature, intermediate stages of the exchanger. By performing the separation of sidestreams 60 and 66 without phase separation, the composition of the stream which performs colder cooling duty in stage 30 is not isolated in heavy components of the refrigerant mix, but rather utilizes the same composition as the previous refrigerant streams 60 and 66. Although the flowscheme of the high level refrigerant cycle of the present invention is shown using four stages in the auxiliary heat exchanger and a three stage compressor, it is contemplated that fewer or more stages of heat exchange or compression may be found to be desirable for a particular application. However, the principals of initial phase separation, total condensation against ambient cooling fluid and refrigerant stream splitting without further phase separation, will be applicable to such alternate configurations.

Figure 2:
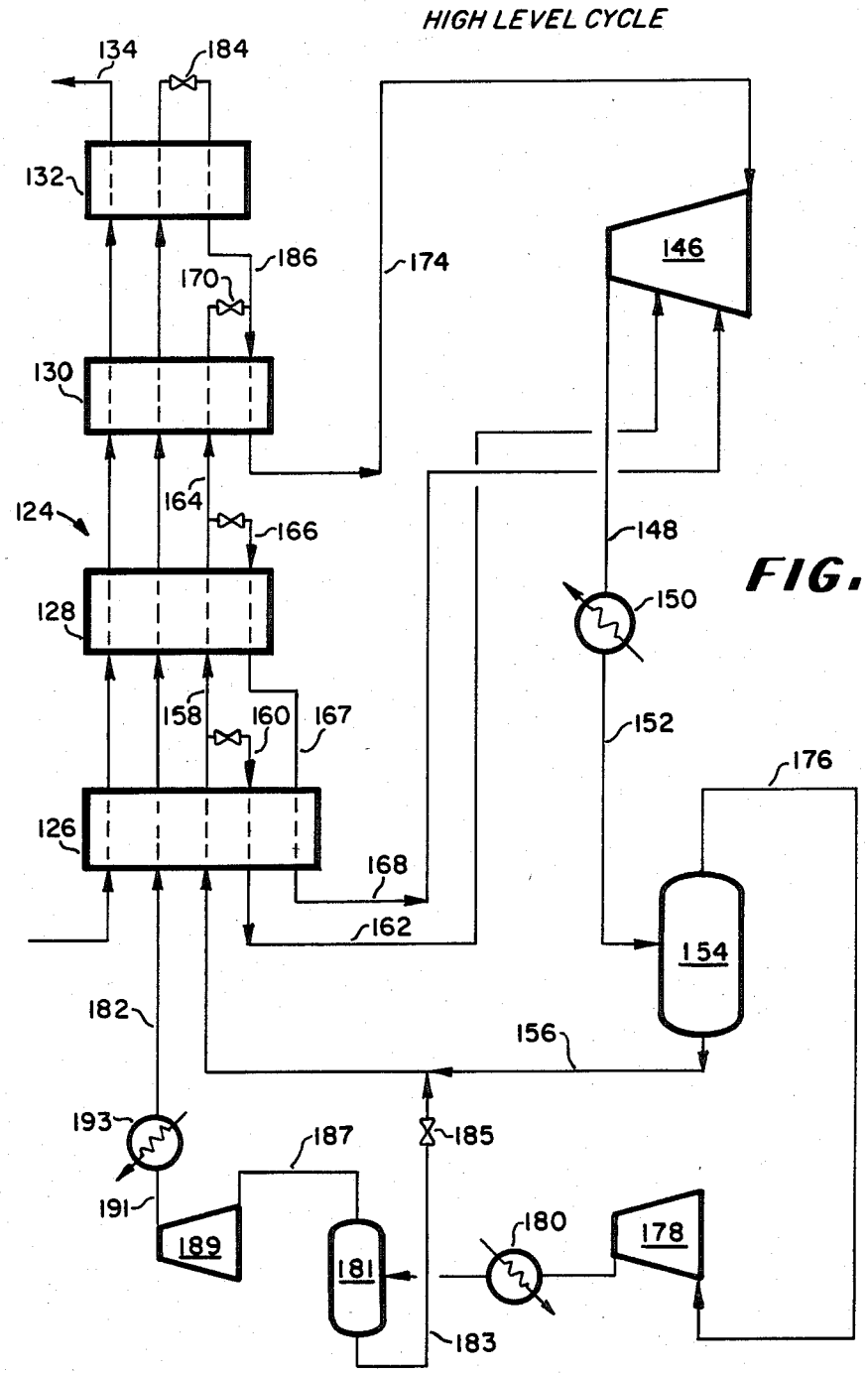
FIG. 2 is a partial flowscheme of the present invention showing alternate modes of operation of the high level refrigerant cycle shown in FIG. 1.

Various alternate configurations of the present invention which further distribute the components of the multicomponent high level refrigerant are contemplated and are set forth in FIG. 2. With reference to FIG. 2, alternate embodiments of the flowscheme of the high level refrigerant cycle are set forth in isolation from the overall cycle as depicted in FIG. 1. Components set forth in FIG. 2 which correspond to the high level cycle in FIG. 1 are identified with similar numbers preceeded by the numeral 1. Therefore, high level refrigerant is compressed to pressure in compressor 146. The compressed refrigerant in line 148 is then aftercooled to partial condensation in aftercooling heat exchanger 150 against ambient external cooling fluid, such as water. The partially condensed refrigerant in line 152 is then initially phase separated in separator 154. The vapor phase of the refrigerant is removed from the top of separator 154 in line 176 and subjected to further compression in compressor 178. Compression is only performed to a level that will allow partial, rather than full, condensation in aftercooling heat exchanger 180, which is supplied with ambient external cooling fluid. Only partial liquefaction allows the refrigerant stream to be phase separated in a second in separator 181. The liquid phase is removed as a bottom stream in line 183 and the vapor phase is removed as an overhead stream in line 187. The vapor phase stream in line 187 is further compressed in compressor 189 to a pressure such that the stream in line 191 can be fully condensed and liquefied against ambient external cooling fluid in aftercooling heat exchanger 193. Therefore, the refrigerant in line 182 is introduced into the auxiliary heat exchanger 124 in the liquid phase.

The liquid phase refrigerant in line 182 passes through all of the various stages 126, 128, 130 and 132 of the auxiliary heat exchanger 124 in order to be cooled by the flashed high level refrigerant. The refrigerant in line 182 after passing through the low level stage 132 of the heat exchanger 124 is flashed through valve 184 to a lower temperature and pressure and returns countercurrently through the low level stage 132 to perform refrigeration duty therein.

The liquid phase refrigerant from the initial phase separator 154 is removed as a bottom stream in line 156. After appropriate let down in pressure through valve 185 the liquid phase stream 183 from the second phase separator 181 is combined with the liquid phase in line 156 and the combined streams are introduced into the high level stage 126 of the auxiliary heat exchanger 124. A sidestream 160 is split out from the remaining stream 158 of the liquid phase refrigerant passing through the high level stage 126. The sidestream is flashed to lower temperature and pressure through a valve before returning countercurrently through the stage 126 to provide cooling therein. The refrigerant is then returned in line 162 for recompression.

Alternately, refrigerant in line 183 can be individually passed through stages 126, 128 and 130 of the auxiliary exchanger, expanded in valve 170 and combined with stream 186 to provide cooling duty in stage 130, wherein the refrigerant is further isolated in light components than that flow path shown in FIG. 2.

The remaining liquid phase refrigerant stream in line 158 passes through the intermediate level stage 128 and again is split into a sidestream 166 and a remaining stream 164. The sidestream 166 is flashed to lower temperature and pressure through a valve before performing the refrigeration duty in intermediate level stage 128 wherein the stream 166 passes countercurrently through the stage 128 and is further passed through stage 126 in line 167. By passing sidestream 166 through two stages of the auxiliary heat exchanger 124 the temperature approach of the refrigerant in line 158 is allowed to be colder and more closely matched against the refrigeration duty it is required to perform without the returning refrigerant in line 167 to recompression having multiple phases wherein the liquid phase would interfere with the operation of the compressor 146. The passage of the refrigerant in line 167 through the additional stage of heat exchange in stage 126 rewarms the refrigerant such that the refrigerant in line 168 is all in the vapor phase. The remaining liquid phase refrigerant in line 164 is further cooled in stage 30 before being reduced in temperature and pressure through valve 170. The refrigerant is combined with the returning refrigerant in line 186 from the low level stage 132. The combined refrigerant passes countercurrently through intermediate level stage 130 and returns in line 174 for recompression in compressor 146. This alteration in the flowscheme from that depicted in FIG. 1 also allows low level refrigerant in line 134 and high level refrigerant line 182 to approach the low level stage 132 of the auxiliary heat exchanger 124 at the coldest possible temperature without creating two phase flow in the refrigerant in line 186 which returns to compressor 146. By combining the refrigerant in line 186 with the liquid refrigerant in line 164 and performing additional refrigeration duty in intermediate level stage 130, the two phase problem is avoided.

This embodiment provides advantages for performing low level refrigeration duty in a highly efficient manner. The initial phase separation occuring in separator 154 isolates the lighter components of the multicomponent refrigerant in the vapor phase 176. The heavier components are isolated in the liquid phase in line 156. As described with respect to FIG. 1 above, this separation of the various components of the multicomponent refrigerant provides efficiencies in the refrigeration duty at various stages of heat exchange with the separate low level refrigerant cycle. In order to further enhance this effect, the present alternate embodiment adjusts compression and aftercooling of the vapor stream in line 176 so that total condensation does not occur, but rather further phase separation is effected in separator 181. This second phase separation achieves an additional level of light component isolation in the refrigerant in line 187. Intermediate heavy refrigerant components are rejected in line 183 and after appropriate pressure adjustment in valve 185, such intermediate refrigerant components are combined with the heavier refrigerant components in line 156. In this manner, the refrigeration duty in stage 132 of the auxiliary heat exchanger 124 which is the coldest refrigeration requirement is performed with refrigeration from the multicomponent refrigerant having the greatest concentration of light components. The light components are most efficient for performing refrigeration duty at the lowest temperatures, such as occur in the low level stage 132. Therefore, the cycle of this embodiment provides increased efficiency for the refrigeration duty while incurring an additional capital requirement for the apparatus downstream of aftercooling heat exchanger 180. With the additional capability of cooling to lower temperatures, it is appropriate to provide safeguards against two phase return flow to the compressor 146. The compressor 146 can be damaged by operation when compressing feed having any significant liquid phase. Therefore, by passing returning refrigerant streams through several stages of heat exchanger, cold level operation is provided while preventing two phase return flow to the compressor. As recited for the flowscheme of FIG. 1 above, the flowscheme depicted in FIG. 2 utilizes ambient external cooling fluid to fully condense all of the refrigerant to the auxiliary heat exchanger 124. It has been found that increased efficiencies occur when such total condensation occurs against the ambient cooling fluid. The use of additional compression in compressors 178 and 189 allows the ambient cooling fluid to accomplish such total condensatiion.

The use of dual mixed refrigerant cycles in a liquefaction scheme allows for a significant degree of freedom in the variation of the composition of each refrigeration cycle both in the makeup of the refrigerant introduced into the cycle at startup, as well as variation of the composition within the cycle as depicted in the high level cycle in FIG. 1 and FIG. 2 of the present invention. Refrigeration variation allows a more precise approach to cooling curves with respect to the material to be cooled and the refrigerant performing the cooling duty. In addition, mixed component refrigerant allows for the variation of compression power load from one cycle to the other cycle in order to provide a good machinery fit particularly when the drivers for the various compressors are required to be matched with regard to load. In addition, shifts of a disproportionate amount in such load can be experienced with regard to different ambient cooling fluid temperatures or feed gas pressure and composition. The use of a dual mixed component refrigerant liquefaction scheme allows for the rematching of the loads without alteration of the equipment through which the refrigerant flows.

Although the liquefaction plant is shown having an auxiliary exchanger with the cold stage at the upper most position, it is contemplated that the auxiliary exchanger could be operated with the cold stage at the bottom and the respective streams introduced in an opposite manner through the exchanger than as shown in FIG. 2.

Also, although FIG. 1 shows the low level refrigerant cycle performing all of the precool function on the natural gas feed in exchanger 12, it is contemplated that the high level refrigerant could assist this precool function by passing a slipstream of high level refrigerant through exchanger 12 or passing a slipstream of natural gas through exchanger 24.

The present invention has been described with respect to several preferred embodiments, but variations from these embodiments can be contemplated by those skilled in the art which variations are deemed to be within the scope of the invention. Therefore the scope of the invention should be ascertained by the claims which follow.

I claim:

1. In a process for the liquefaction of natural gas using two closed cycle, multicomponent refrigerants wherein high level refrigerant cools the low level refrigerant and the low level refrigerant cools and liquefies the natural gas, comprising;

cooling and liquefying a natural gas stream by heat exchange with a low level multicomponent refrigerant in a first closed refrigeration cycle, which refrigerant is rewarmed during said heat exchange, compressing said rewarmed low level refrigerant to an elevated pressure and aftercooling it against an external cooling fluid, further cooling said low level refrigerant by multiple stage heat exchanger against a high level multicomponent refrigerant in a second closed refrigeration cycle, with high level refrigerant is rewarmed during said heat exchange, compressing said rewarmed high level refrigerant to an elevated pressure and aftercooling it against an external cooling fluid to partially liquefy said refrigerant, the improvement for varying the composition of the high level refrigerant such that lighter molecular weight components are available to perform the lower level refrigeration duty by;

phase separating said high level refrigerant into a vapor phase refrigerant stream and a liquid phase refrigerant stream, subcooling and expanding portions of the liquid phase refrigerant stream to lower temperature and pressure in multiple stages to provide the cooling of the low level refrigerant and to cool and liquefy the vapor phase refrigerant stream, and compressing the vapor phase refrigerant stream and condensing it against an external cooling fluid, before subcooling it against the liquid phase stream and expanding it to lower temperature and pressure to provide the lowest stage of cooling to the low level refrigerant.

2. The process of claim 1 wherein the high level vapor phase refrigerant stream after being rewarmed in the final stage of the heat exchange with the low level refrigerant is combined with the liquid phase refrigerant for heat exchange in an intermediate stage of said heat exchange with said low level refrigerant.

3. The process of claim 1 wherein the high level refrigerant from a lower temperature stage of heat exchange with the low level refrigerant is further conducted through a higher stage of heat exchange with said low level refrigerant.

4. The process of claim 1 wherein the vapor phase high level refrigerant after compression is only partially liquefied and then phase separated with the liquid phase being combined with the liquid phase high level refrigerant and the vapor phase being further compressed and condensed against an external cooling fluid.

5. In an installation for the liquefaction of natural gas using two closed cycle, multicomponent refrigerants wherein high level refrigerant cools the low level refrigerant and the low level refrigerant cools and liquefies the natural gas comprising:

a first heat exchanger for cooling and liquefying natural gas against a low level refrigerant;

at least one compressor for compressing low level refrigerant to an elevated pressure;

an auxiliary heat exchanger for cooling the low level refrigerant against high level refrigerant in multiple stages;

a phase separator for separating the low level refrigerant into a vapor phase stream and a liquid phase stream;

means for conveying the vapor phase stream and the liquid phase stream separately to said first heat exchanger and recycling same to said compressor;

at least one compressor for compressing high level refrigerant to an elevated pressure;

an aftercooling heat exchanger for cooling the compressed high level refrigerant against an external cooling fluid, the improvement for varying the composition of the high level refrigerant such that lighter molecular weight components are available to perform the lower level refrigeration duty including;

a phase separator for separating the high level refrigerant into a vapor phase stream and a liquid phase stream;

a compressor and aftercooling heat exchanger for liquefying said vapor phase stream of said high level refrigerant;

means for conveying said high level vapor phase stream through said auxiliary heat exchanger and expanding said stream in order to cool the low level refrigerant stream;

means for conveying said high level liquid phase stream through said auxiliary heat exchanger including means for separating portions of said stream therefrom and then individually expanding them to a lower temperature and pressure to cool said low level refrigerant, and means for recycling the high level refrigerant for recompression.

6. The apparatus of claim 5 including a second phase separator for separating a second liquid phase high level refrigerant stream, means for combining the second liquid phase stream with the first liquid phase high level refrigerant stream, a compressor and an aftercooling heat exchanger for liquefying the vapor phase from the second phase separator.

* * * * *